US005334847A

United States Patent [19]

Kronberg

[11] Patent Number: 5,334,847

[45] Date of Patent: Aug. 2, 1994

[54] COMPOSITION FOR RADIATION SHIELDING

[75] Inventor: James W. Kronberg, Aiken, S.C.

[73] Assignee: The United States of America as represented by the Department of Energy, Washington, D.C.

[21] Appl. No.: 14,604

[22] Filed: Feb. 8, 1993

[51] Int. Cl.[5] ..... G21F 1/12

[52] U.S. Cl. ..... 250/506.1; 250/515.1; 250/518.1

[58] Field of Search ..... 250/506.1, 515.1, 518.1

[56] References Cited

U.S. PATENT DOCUMENTS

| | | | |
|---|---|---|---|
| Re. 29,876 | 1/1979 | Reese | 250/506 |
| 3,016,463 | 1/1962 | Needham | 250/506.1 |
| 3,732,423 | 5/1973 | Peterson | 250/506.1 |
| 4,123,392 | 10/1978 | Hall et al. | 252/478 |
| 4,868,400 | 9/1989 | Barnhart et al. | 250/506.1 |
| 5,015,863 | 5/1991 | Takeshima et al. | 250/515.1 |

*Primary Examiner*—Jack I. Berman

*Attorney, Agent, or Firm*—Brian R. Tumm; Harold M. Dixon; William R. Moser

[57] ABSTRACT

A composition for use as a radiation shield. The shield has a depleted uranium core for absorbing gamma rays and a bismuth coating for preventing chemical corrosion and absorbing gamma rays. Alternatively, a sheet of gadolinium may be positioned between the uranium core and the bismuth coating for absorbing neutrons. The composition is preferably in the form of a container for storing materials that emit radiation such as gamma rays and neutrons. The container is preferably formed by casting bismuth around a pre-formed uranium container having a gadolinium sheeting, and allowing the bismuth to cool. The resulting container is a structurally sound, corrosion-resistant, radiation-absorbing container.

14 Claims, 1 Drawing Sheet

COMPOSITION FOR RADIATION SHIELDING

The United States Government has rights in this invention pursuant to Contract No. DE-AC09-89SR18035 between the U.S. Department of Energy and Westinghouse Savannah River Company.

BACKGROUND OF THE INVENTION

1. Field of the Invention

The present invention relates to ionizing radiation shields. More particularly, the present invention relates to a shielding composition for attenuating gamma rays and absorbing neutrons.

2. Discussion of Background

In working with high-level radioactive materials, such as spent nuclear fuels, nuclear waste and industrial radiation sources, the use of thick shielding, remote manipulation, or both is necessary to minimize radiation exposure to human operators.

Lead has often been used for gamma ray shielding because it is dense, easily worked and relatively inexpensive. Also, a lead shield can often be smaller than a comparable radiation shield made of virtually any other material so it takes up less space and is more portable.

However, lead is a toxic metal that is slowly attacked and corroded by air, water and soil acids. Also, water-soluble lead compounds, such as lead carbonate, tend to persist in the environment for long periods of time and are highly toxic to humans and other forms of life.

Lead tends to accumulate in the body, similar to other heavy-metal poisons, and continues producing toxic effects for many years after exposure. Therefore, it is desirable to eliminate lead from many of its present uses, including radiation shielding, and to find substitutes for lead.

Depleted uranium (chiefly uranium-238) is well known for use in absorbing gamma radiation. For example, Takeshima et al, in U.S. Pat. No. 5,015,863, discloses the use of depleted uranium particles for radiation shielding. Also, Barnhart et al, in U.S. Pat. No. 4,868,400, discloses the use of depleted uranium rods or small balls as radiation shielding in an iron cask for shipping and storing spent nuclear fuel.

However, U-238 is radioactive, with a half-life of about 4.5 billion years, and undergoes about 12,000 disintegrations per gram per second. Uranium, in addition to being radioactive, is readily corroded. Also, its soluble salts are quite toxic. However, uranium is not as likely as lead to accumulate in the body.

Because of its radioactivity, its tendency to corrode or other factors, uranium is usually accompanied by an overcoating of a non-radioactive, highly absorbent material, such as lead. In U.S. Pat. No. Re. 29,876, Reese discloses a depleted uranium container, with a corrosion-free coating of stainless steel, for transporting radioactive materials. Takeshima, in U.S. Pat. No. 5,015,863, uses depleted uranium particles coated with a metal of high thermal conductivity, such as aluminum, copper, silver, magnesium, or the like.

As for shielding neutrons, cadmium is the material most known for such use. Other neutron-absorbing materials exist, but do not absorb neutrons as well as cadmium and also have disadvantages that discourage their use. For example, hydrogen, the most common neutron absorber, is readily available and non-toxic, but hydrogen has a relatively small absorption cross-section, or probability of a nucleus absorbing a neutron. Also, lithium and boron, which are relatively better neutron absorbers, are both chemical poisons and are difficult to handle in the metallic state.

Cadmium-113 absorbs thermal (low energy) neutrons extremely well but, like uranium, is a radioactive material with a very long half-life. Also, cadmium is very toxic to humans, with effects on the central nervous system similar to those of mercury.

Because of the undesirable features of cadmium as a neutron absorber, gadolinium is sometimes substituted. Gadolinium is a rare-earth metal existing in seven natural isotopes. Only one of these isotopes is slightly radioactive, and it makes up only 0.2% of the total metal. Natural gadolinium averages only about one gadolinium-152 disintegration per gram in each ten minutes, and thus is considered to be non-radioactive for most purposes.

Gadolinium is used primarily in controlling the chain reaction in nuclear energy production. Gadolinium is also known as a shielding material, especially in storing radioactive materials, as is disclosed by Takeshima et al in U.S. Pat. No. 5,015,863 and Barnhart et al in U.S. Pat. No. 4,868,400.

Both gadolinium-155 and gadolinium-157 have much higher neutron absorption cross-sections than cadmium (three times and twelve times that of cadmium-113, respectively). Moreover, each of these isotopes makes up a higher percentage of gadolinium metal than does the isotope cadmium-113 in cadmium. Therefore, a neutron absorber made substantially of gadolinium does not have to be as pure as one made of cadmium to absorb thermal neutrons as effectively.

In nature, gadolinium occurs mixed with other rare-earth metals, but can be separated by well known techniques such as ion-exchange and the like. Gadolinium is malleable, ductile, and available in a number of forms, including sheets, foil and wire. Gadolinium is stable in dry air, but is attacked by acids and moist air. Thus, gadolinium requires varying degrees of protection for certain applications.

Despite the availability of radiation shield materials such as depleted uranium, which absorbs gamma rays, and gadolinium, which absorbs neutrons, there remains a need for more effective radiation shielding.

SUMMARY OF THE INVENTION

According to its major aspects and broadly stated, the present invention is a composition for radiation shielding. In particular, it is a radiation shield with a depleted uranium core for absorbing gamma rays and a bismuth coating for preventing chemical corrosion and absorbing gamma rays. Alternatively, a sheeting of gadolinium may be positioned between the uranium core and the bismuth coating for absorbing neutrons. The composition is preferably formed into a container for storing radioactive materials. The container is formed by pre-forming uranium into a vessel, adding gadolinium sheeting to the vessel if neutron absorption is needed, and casting bismuth around the pre-formed uranium/gadolinium vessel. The resulting container is a structurally-sound, corrosion-resistant metallic block having strong radiation-attenuating properties, yet has a non-toxic, non-radioactive surface.

A major feature of the present invention is the use of bismuth as a coating for a uranium shield. In addition to absorbing gamma rays, the bismuth coating protects the shield from corrosion. In a container for transportation of radioactive materials from a facility, a corrosion-free surface is important not only for a long-lived container but also for making the requisite measurements of contamination that might have gotten on the exterior surface of the container before such a container can depart the facility. If the container is to be used for permanent disposal of the radioactive material, corrosion resistance is essential to prevent loss of container integrity before radioactive decay is complete.

Another feature of the present invention is the interaction between bismuth and both uranium and gadolinium. Bismuth, when molten, spreads evenly over both uranium and gadolinium without dissolving significant amounts of either material. Upon cooling, the bismuth adheres strongly to the material, forming a high-melting, intermetallic compound. This feature provides a high-integrity coating that will not be removed easily, even under extreme conditions.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Bismuth, in its natural state, consists entirely of the isotope 209, which has a half-life of approximately one pentillion ($10^{18}$) years and thus is essentially non-radioactive. Bismuth has a relatively low melting point of 271° C., which is approximately midway between the melting points of tin and lead. The density of bismuth is 9.75 grams/cubic centimeter (86% of the density of lead), making it a good absorber of alpha, beta and gamma radiation; moreover, its gamma-ray absorption spectrum compliments that of uranium in that the absorption "edges", corresponding to ionization thresholds of inner shell electrons, appear at quite different energies. At present, bismuth is relatively inexpensive ($0.10 per gram for 99.5% purity).

Despite being brittle and thus difficult to machine, bismuth is easily shaped by casting, since it expands approximately 3% upon solidification. Although hot, concentrated mineral acids will attack it, bismuth is otherwise immune to corrosion under most environmental conditions. Also, since bismuth forms salts that hydrolyze in water to become insoluble, it is virtually non-toxic.

Bismuth forms high-melting, intermetallic compounds with both uranium and gadolinium, and thus wets both materials. However, molten bismuth close to its melting point will not dissolve significant amounts of either material, or a compound of the two.

As a result, bismuth will "tin" both of these metals. That is, molten bismuth will spread over them when molten and adhere strongly to them when cooled. This is similar to the manner in which tin or its alloys coat and adhere to copper or brass. Since bismuth is itself resistant to environmental corrosion, a coating of bismuth will protect a radiation shield made of less resistant metals, such as uranium and gadolinium, from attack by water, air or soil acids.

Figure 1:
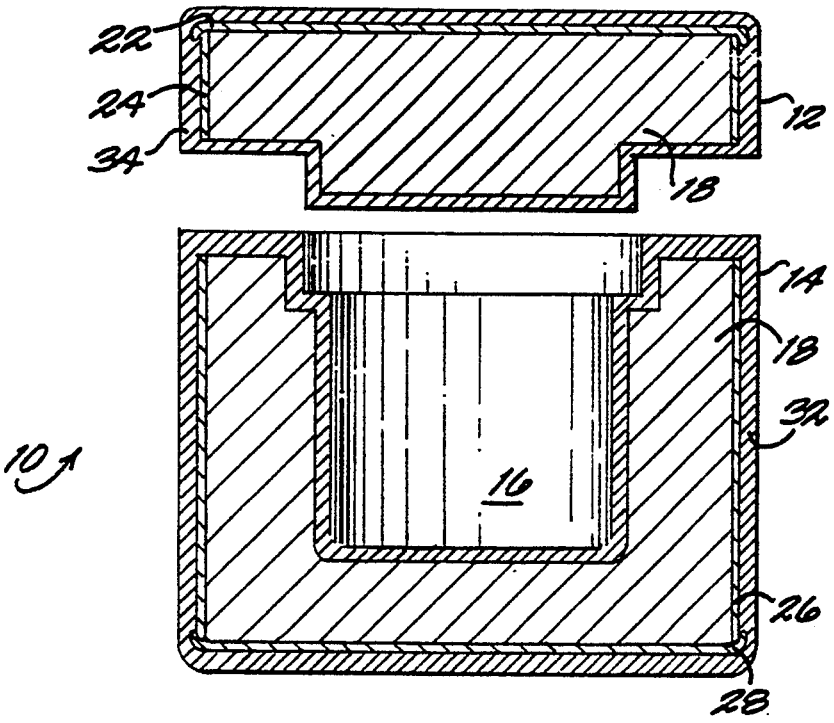
FIG. 1 is a cross-sectional view of a container, for storing materials emitting ionizing radiation, which is made of a composition according to a preferred embodiment of the present invention.

Referring now to FIG. 1, the composition in its preferred embodiment is a container 10 for transporting or storing radioactive material. Container 10, preferably rectangular in shape, comprises a lid 12 and a hollow body 14 forming a central cavity 16.

Lid 12 and body 14 are both formed by machining or otherwise forming depleted uranium 18 into respective shapes that are slightly undersized from the desired final dimensions. The shape of body 14, for example, can be formed from a single piece of uranium 18 or, alternatively, from several pieces of uranium 18 held together by appropriate means, such as machine screws or the like. Preferably, each piece of uranium 18 is coated thinly with bismuth, such as by dipping the pieces of uranium 18 into a bath of molten bismuth prior to assembly.

If container 10 is to be used for storing or transporting materials having significant neutron emission, body 14 and lid 12 each are equipped with an outer jacket made of a neutron absorber, such as gadolinium. Preferably, lid 12 is equipped with gadolinium pieces 22, 24, also coated with a thin sheet of bismuth before assembly, and applied on the outer areas of lid 12. Similarly, body 14 is equipped with pre-coated gadolinium pieces, such as pieces 26, 28, formed on the outer surface of body 14.

Body 14, with or without a gadolinium outer surface, is then coated with a layer of bismuth 32 by an appropriate means, such as by dipping body 14 into a bath of molten bismuth. Preferably, body 14 is placed in a mold made of a high-melting metal to which bismuth does not adhere, such as stainless steel, and molten bismuth is poured into the mold. Body 14 is positioned within the mold so that molten bismuth poured into the mold covers the entire surface area of body 14. Upon cooling, the mold is removed. A similar process is performed on lid 12 whereby a coating of bismuth 34 is applied to lid 12.

Figure 2:
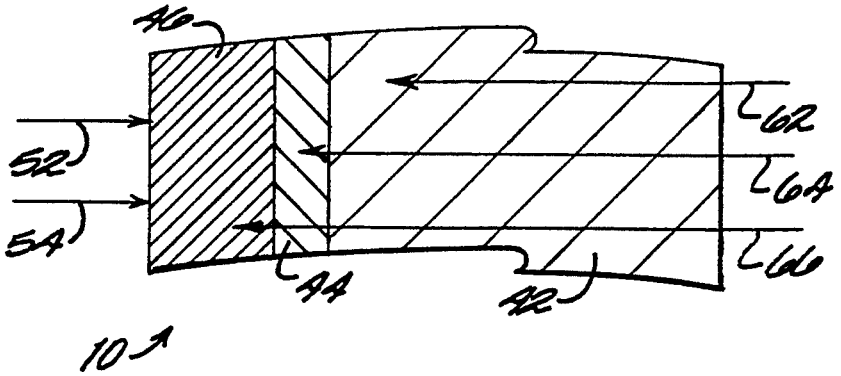
FIG. 2 is a partial cross-sectional view of a segment of a composition according to the preferred embodiment of the present invention.

In FIG. 2, a cross-section of the composition 40 in its preferred embodiment is shown. Composition 40 comprises a layer of uranium 42, which is preferably depleted uranium, an intermediate layer of gadolinium 44, and an outside layer or coating of bismuth 46. Bismuth layer 46, being corrosion resistant, prevents attacks by water, air, soil acids, and the like (shown generally as arrows 52, 54) on gadolinium layer 44 and uranium layer 42, both of which are less resistant to environmental corrosion.

In use, composition 40 is placed between a radiation source (not shown) and the area to be shielded so that uranium layer 42 is closest to the radiation source. As previously stated, bismuth layer 46, which is corrosion resistant, protects gadolinium layer 44 and uranium layer 42 from environmental corrosion 52, 54, thereby prolonging the structural integrity of composition 40 and its use as a radiation shield.

Most gamma rays (shown generally as arrow 62) emitted from the radiation source are absorbed by uranium layer 42. Any neutron emission (shown generally as arrow 64) from the radiation source will be absorbed by gadolinium layer 44. Bismuth layer 46 absorbs additional stray gamma rays (shown generally as arrow 66) and the bulk of radiation emitted from uranium layer 42, in addition to protecting gadolinium layer 44 and uranium layer 42 from environmental corrosion.

It will be apparent to those skilled in the art that many changes and substitutions can be made to the preferred embodiment herein described without departing from the spirit and scope of the present invention as defined by the appended claims.

What is claimed is:

1. A shield for ionizing radiation, said shield comprising:

a body made of uranium and having an exterior; and a bismuth coating adhered to said exterior of said body, said coating being made of a corrosion-resistant material and adhering to said exterior by forming an intermetallic compound.

2. The shield as recited in claim 1, further comprising a layer made of gadolinium being adhered to said exterior of said body, said bismuth coating being adhered to said gadolinium layer.

3. The shield as recited in claim 1, wherein said bismuth coating is applied to said exterior of said body by a method comprising the steps of:

heating said first material to approximately 300° C.;

heating said bismuth until said bismuth is molten; and pouring said bismuth over said first material.

4. The shield as recited in claim 1, wherein said shield is for use with a source of ionizing radiation, and wherein said body is a container for storing said source.

5. The shield as recited in claim 1, wherein said bismuth coating is applied to said exterior of said body by heating said bismuth until said bismuth is molten and then dipping said first material into said molten bismuth.

6. Apparatus for storing a source of ionizing radiation, said apparatus comprising:

a body made of uranium, said body having a first surface and a cavity with an interior surface and an opening, said cavity dimensioned to receive said source;

a lid dimensioned to cover said opening, said lid made of uranium and having a second surface;

a first bismuth coating adhering to said first surface, said first coating made of a corrosion-resistant material, said first coating forming an intermetallic compound with said first material;

a second bismuth coating adhering to said second surface, said second coating made of a corrosion-resistant material, said second coating forming an intermetallic compound with said second surface; and a third coating adhering to said interior surface, said third coating made of a corrosion-resistant material, said third coating forming an intermetallic compound with said interior surface.

7. The apparatus as recited in claim 6, wherein said first surface further comprises a first external layer of gadolinium, said second surface further comprises a second external layer of gadolinium and said interior surface further comprises a third external layer of gadolinium, said first coating being adhered to said first external layer, said second coating being adhered to said second external layer, and said third coating being adhered to said third external layer.

8. The apparatus as recited in claim 6, wherein said bismuth is applied to said first surface and said interior surface by a method comprising the steps of:

heating said uranium body to approximately 300° C.;

heating said bismuth until said bismuth is molten; and pouring said bismuth over said uranium body.

9. The apparatus as recited in claim 6, wherein said second bismuth coating is applied to said second surface by heating said bismuth until said bismuth is molten and then dipping said lid into said molten bismuth.

10. A method for making a shield for ionizing radiation, said method comprising the step of applying a bismuth coating to a first material so that said coating adheres to said first material and forms an intermetallic compound with said first material, said first material absorbing gamma radiation.

11. The method as recited in claim 10, wherein said first material is made of uranium, further comprising the step of coating said uranium with a layer of gadolinium.

12. The method as recited in claim 10, wherein said applying step further comprises the steps of heating said bismuth until said bismuth is molten and then pouring said bismuth over said first material.

13. (Amended) The method as recited in claim 10, wherein said applying step further comprises the steps of heating said bismuth until said bismuth is molten and then dipping said first material into said molten bismuth.

14. The method as recited in claim 10, wherein said first material is uranium, further comprising the steps of:

coating said uranium with a layer of gadolinium;

heating said bismuth until said bismuth is molten; and then pouring said bismuth over said first material, said bismuth adhering to said layer of gadolinium.

* * * * *